US005670922A

United States Patent [19]

Montague et al.

[11] Patent Number: 5,670,922

[45] Date of Patent: Sep. 23, 1997

[54] CIRCUIT BREAKER MAGNETIC TRIP UNIT

[75] Inventors: Wade A. Montague, Southington; John H. Whiton, S. Windsor; Marshall B. Hart, Middletown; Roger J. Morgan, Simsbury; David Arnold, Chester, all of Conn.

[73] Assignee: General Electric Company, New York, N.Y.

[21] Appl. No.: 652,763

[22] Filed: May 23, 1996

[51] Int. Cl.[6] ..... H01H 75/12

[52] U.S. Cl. ..... 335/35; 335/172; 335/23

[58] Field of Search ..... 335/23–25, 35, 335/167–176

[56] References Cited

U.S. PATENT DOCUMENTS

| | | | |
|---|---|---|---|
| 3,244,835 | 4/1966 | Locher | 335/35 |
| 3,421,123 | 1/1969 | Johnson et al. | 335/23 |
| 4,609,898 | 9/1986 | Seymour et al. . | |
| 4,679,016 | 7/1987 | Ciarcia et al. . | |
| 4,771,254 | 9/1988 | DiVincenzo . | |

*Primary Examiner*—Lincoln Donovan

*Attorney, Agent, or Firm*—Richard A. Menelly; Carl B. Horton

[57] ABSTRACT

A magnetic flux concentrator trip unit for molded case circuit breakers in the form of a flux concentrator magnet arranged round the load strap at one end of the circuit breaker is positioned in magnetic proximity to an armature. Current transport through the load strap generates attractive magnetic forces to articulate the circuit breaker operating mechanism when the current exceeds a threshold value.

10 Claims, 2 Drawing Sheets

CIRCUIT BREAKER MAGNETIC TRIP UNIT

BACKGROUND OF THE INVENTION

Molded case circuit breakers rated for residential and lower current industrial applications utilize both thermally-responsive as well as magnetically-responsive trip units for overcurrent and short circuit interruption. The thermal element responds to moderate overcurrent conditions, whereas the magnetic trip unit responds to more severe overcurrent conditions. It is the practice of the circuit protection industry to mount the magnet portion of the magnetic trip unit around the bimetal trip unit and to arrange the armature as part of the circuit breaker latching system. The magnet portion is generally U-shaped in configuration and surrounds the circuit breaker load strap or the thermal element and responds in a manner similar to that of a conventional U-shaped "slot motor" wherein the magnetic forces induced within the magnet are concentrated at the ends of the magnetic arms. The flat plate armature is arranged perpendicularly across the arms with an air gap between the arms and the armature to set the magnetic force. The magnetic force of attraction between the armature and the magnet is such that the minimum magnetic force occurs at the instant of short circuit overload since the magnet and the armature are at their furthest distance apart and the high reluctance air gap at this time is a maximum. As the armature moves toward the magnet under the magnetic force of attraction, the gap distance decreases causing the effective magnetic force to rapidly accelerate. The magnetic force is at a maximum upon the instant of contact between the armature and the magnet, at which time the air gap is effectively zero. One example of a state of the art thermal magnetic trip unit is found within U.S. Pat. No. 4,609,898 in the names of Raymond Seymour et al.

U.S. Pat. No. 4,771,254 entitled "Circuit Breaker Magnetic Trip Unit" discloses that the magnetic trip sensitivity can be substantially increased by utilizing a pair of opposing magnets wherein one of the magnets is fixed and the other is allowed to move, similar to an armature but opposite in direction. The magnetic forces between the magnets are of repulsion and hence the maximum magnetic force occurs at the instant of overcurrent occurrence and decreases thereafter as the movable magnet become displaced and the high reluctance air gap correspondingly increases.

In most circuit breaker designs, it is important to generate a trip force at the instant of overcurrent occurrence such that the largest magnetic trip force occurs instantaneously. In some circuit breaker applications, the thermal trip unit is eliminated such that both long time overcurrent as well as short circuit trip functions are provided by means of a magnetic dashpot trip unit alone. A "dashpot" is an arrangement wherein a magnetic plunger is arranged within a viscous liquid which is encapsulated within a sealed container. A solenoid winding around the container generates a magnetic force in proportion to circuit current. The viscosity of the liquid provides the time overcurrent delay similar to the thermal trip unit. Upon the occurrence of a short circuit condition, the magnetic force generated by the solenoid winding is sufficient to rapidly overcome the liquid velocity to trip the circuit breaker.

It would be economically advantageous to provide a single magnetic trip unit that is sensitive enough to respond to low level overcurrent conditions as well as high current short circuit faults. One purpose of this invention is to provide a single magnetic trip unit having sensitive response to both long time and short time overcurrent as well as short circuit conditions.

SUMMARY OF THE INVENTION

A magnetic flux concentrator trip unit for molded case circuit breakers wherein a flux concentrator magnet is arranged round the load strap at one end of the circuit breaker in magnetic proximity to an armature. Current transport through the load strap generates attractive magnetic forces to articulate the circuit breaker operating mechanism when the current exceeds a threshold value. The magnet is C-shaped to provide a large magnet area in parallel with the armature to promote increased flux transfer between the magnet and the armature.

DESCRIPTION OF THE PREFERRED EMBODIMENT

Figure 1:
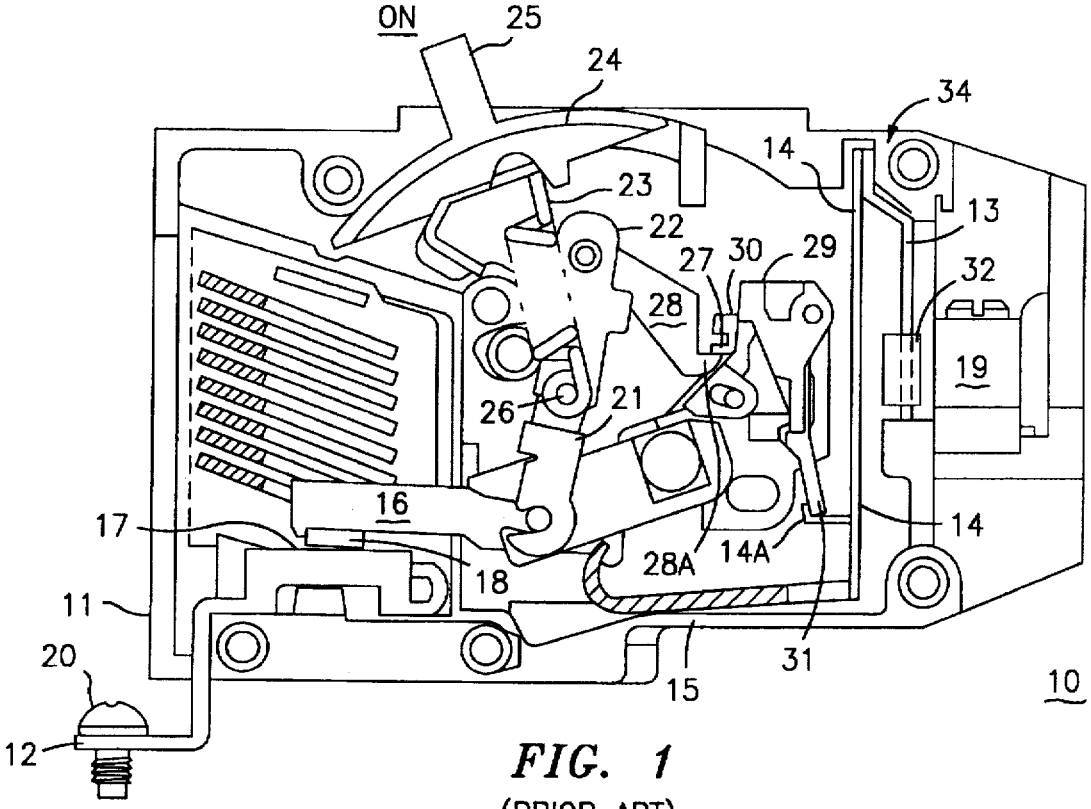
FIG. 1 (PRIOR ART)
FIG. 1 is a side view of a molded case circuit breaker employing a magnetic trip unit according to the prior art.

A molded case circuit breaker 10 according to the prior art is shown in FIG. 1 consisting of a plastic case 11 to which electrical connection is made by means of a line terminal strap 12 and a load terminal strap 13. The circuit through the circuit breaker proceeds through an armature strap 14 and braid conductor 15 to the movable contact arm 16 having a movable contact 17 attached thereto. Electrical connection is completed by means of a fixed contact 18, which connects by means of the line strap 12 with the line terminal screw 20. The movable contact arm 16 operatively connects with an operating handle 25 by means of lower link 21, upper link 22, operating springs 23 and handle yoke 24. The upper and lower links are pivotally connected by means of a pivot pin 26 to which the operating springs 23 connect and which moves the upper and lower links over center when the operating handle is in the ON position, as indicated. The contacts are held in a closed position against the bias provided by the stretched operating springs 23 by the engagement between the end 28A of the cradle 28. The secondary latch 29 interferes with the back surface 30 of the primary latch to further prevent the release of the end 28A of the cradle 28 from the primary latch 27. The magnet trip unit 34 includes a U-shaped magnet 32 which interacts with the armature 14 to attract the armature and remove the armature tab 14A from the trip bar 31 upon the occurrence of an overcurrent condition. The trip bar 31 articulates the operating springs 23 by moving the secondary latch 29 out of contact with the primary latch 27, to thereby allow the cradle 28 to release from the primary latch and to allow the upper and lower links 22, 21 to collapse under the bias of the operating springs to draw the movable contact arm 16 and the movable contact 17 to the open position. The circuit breaker 10 is similar to that described within U.S. Pat. No. 4,679,016 entitled "Interchangeable Mechanism For Molded Case Circuit Breaker" which patent should be reviewed for a good understanding of the interaction of the primary and secondary latches with the operating mechanism. The magnetic trip unit 34 when used to interrupt under so-called "long time" and "short time" conditions eliminates the requirement of a bimetal thermal-responsive trip unit usually required to perform the "long time" trip function and includes a first U-shaped magnet piece 32 encompassing a pad of the load terminal strap 13 and attached thereto by means of a rivet 33. The U-shaped magnet 32 includes a pair of arms 35A, 35B joined by a central bight 36. A second U-shaped magnet piece 37 is attached to the armature 14 and arranged such that the ends 38A, 38B thereof are oppositely adjacent the ends 35A, 35B of the first U-shaped magnet piece 32. The magnetic gap x is adjusted for optimum calibration performance and the magnetic trip unit 34 is attached to the load terminal lug 19 of FIG. 1 by means of the threaded aperture 39.

Figure 3:
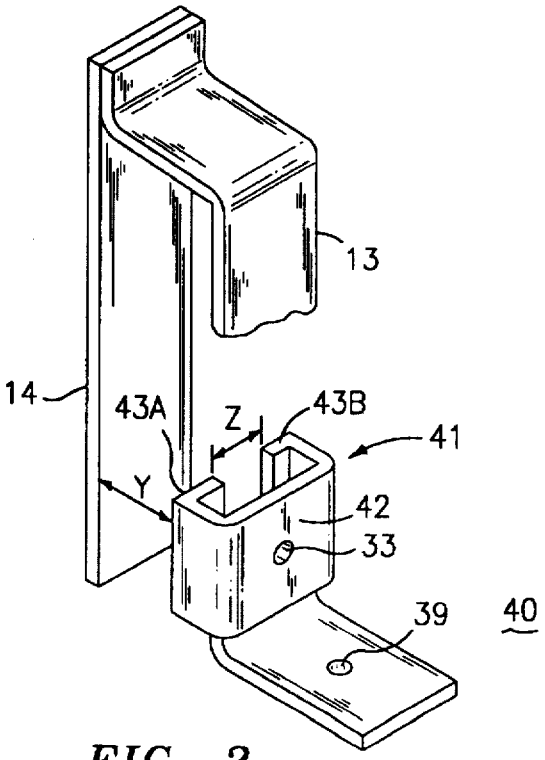
FIG. 3 is an enlarged top perspective view of the magnetic flux concentrator trip unit according to the invention.

The magnetic flux concentrator trip unit 40 according to the invention is depicted in FIG. 3 and contains a similar load strap 13 attached to a similar armature 14 as described earlier. The C-shaped flux concentrator magnet 41 is in the form of pair of side arms 43A, 43B joined by a bight 42. The flux concentrator magnet 41 can be welded to the load strap or attached thereto by means of the rivet 33 and the load strap is attached to the load terminal in the manner described earlier by means of the threaded aperture 39. A relationship exists between the length of the legs 43A, and 43B of the magnet 41 that interfaces the armature 14 as well as between the dimension of the gap y that separates the legs from the armature and the gap z that separates the ends of the legs. To provide optimum magnetic flux concentration between the flux concentrator magnet 41 and the armature 14, the gap Z at the ends of the sidearms 43A, 43B is set slightly greater than the gap y between the sidearms 43A, 43B and the armature 14. The armature 14 can be a bimetal if desired to provide thermal overcurrent sensing. It has been determined that the magnetic flux generated within the flux concentrator magnet 41 upon the transfer of current through the load strap 13 seeks the path of least magnetic reluctance when the path of least reluctance is the shorter of the gaps y or z. By maintaining the gap z greater than the gap y, the flux gathers between the flux concentrator magnet sidewalls 43A, 43B and the armature 14 providing substantial magnetic attraction of the armature 14 to the flux concentrator magnet 41.

Figure 4:
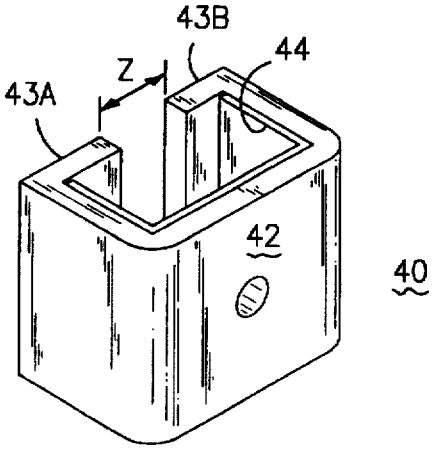
FIG. 4 is an enlarged top perspective view of a further embodiment of the magnetic flux concentrator trip unit according to the invention.
Figure 2:
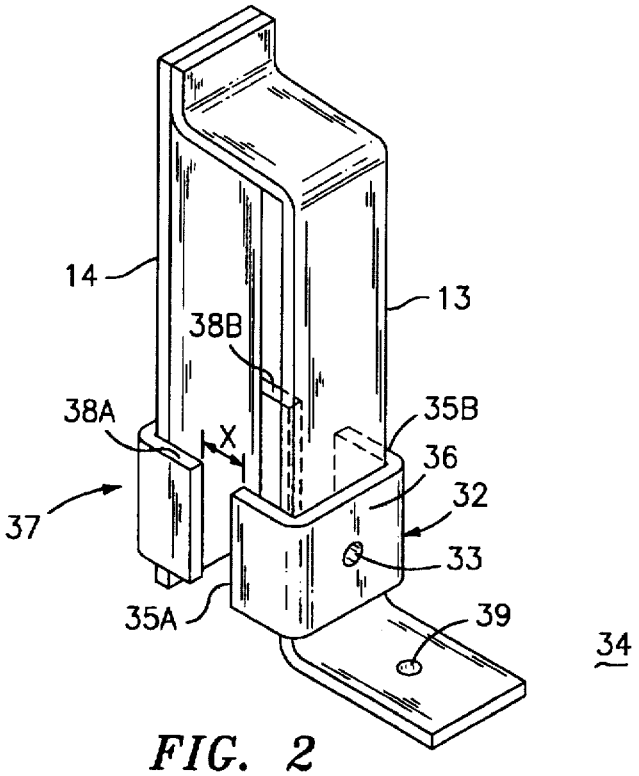
FIG. 2 (PRIOR ART)
FIG. 2 is an enlarged top perspective view of one magnetic trip unit used within the circuit breaker of FIG. 1.

In view of the higher flux concentration, larger magnetic forces are generated at lower current levels resulting in early saturation of the metal used to form the flux concentrator magnet 41. To provide increased magnetic response at higher currents without incurring saturation, the C-shaped flux concentrator magnet 41 of FIG. 4 is proposed. The arrangement of the gap z between the ends of the sidearms 43A, 43B and the joining of the sidearms by means of the bight 42 is similar to that of FIG. 3. To provide for increased metal material in the vicinity of the generation of magnet flux, a U-shaped metal insert 44 is positioned within the flux concentrator magnet 41 intermediate the bight 42 and the sidearms 43A, 43B and in close contact with the bight 42. The additional metal in the vicinity of flux generation allows the magnetic flux to be increased at high current loadings without incurring saturation.

A magnetic trip unit has herein been described having increased magnetic flux generation at lower generating current levels. The magnetic trip unit can be used in conjunction with a thermal trip element or as a stand-alone trip unit per se.

We claim:

1. A magnetic trip unit comprising:

a C-shaped metal plate comprising a U-shaped bight having a pair of endwalls extending from opposite ends of said U-shaped bight, said endwalls being arranged for partially encompassing a metal conductor and generating a magnetic flux within said plate in response to current transport through the conductor;

a first gap defined between opposing ends of said endwalls, said first gap being spaced for maximum flux egress from side edges of said endwalls to an adjacent armature; and a second gap defined between said endwalls and said armature, said second gap being sized relative to said first gap to promote further transfer of said magnetic flux between said edges of said endwalls and said armature.

2. The magnetic trip unit of claim 1 wherein said armature comprises a bimetal.

3. The magnetic trip unit of claim 1 wherein said armature is attached to said conductor.

4. The magnetic trip unit of claim 1 including a metal insert within said plate intermediate said sidewalls and said bight.

5. A circuit breaker comprising:

a molded plastic case;

a line strap at one end of said case and a load strap at an opposite end thereof, said load strap being arranged for connection with an electric circuit;

a pair of contacts within said case for transfer of current between said load and line straps when said current is below a predetermined level;

an operating spring charged for separation of said contacts when said current is above a predetermine level;

a cradle interacting with a latch for restraining said operating spring; and a C-shaped metal plate comprising a U-shaped bight having a pair of endwalls extending from opposite ends of said U-shaped bight, said endwalls being arranged for partially encompassing a metal conductor and generating a magnetic flux within said plate in response to current transport through the conductor;

a first gap defined between opposing ends of said endwalls, said first gap being spaced for maximum flux egress from side edges of said endwalls to an adjacent armature; and a second gap defined between said endwalls and said armature said second gap being sized relative to said first gap to promote further transfer of said magnetic flux between said side edges of said endwalls and said armature.

6. The circuit breaker of claim 5 wherein said trip unit includes a metal insert within said plate intermediate said sidewalls and said bight.

7. The circuit breaker of claim 5 wherein said armature comprises a bimetal.

8. The circuit breaker of claim 5 wherein said armature is attached to said conductor.

9. The circuit breaker of claim 5 including a metal insert within said plate intermediate said sidewalls and said bight.

10. The circuit breaker of claim 5 wherein said second gap is greater than said first gap.

* * * * *